US012798821B2

(12) United States Patent
Jensen

(10) Patent No.: US 12,798,821 B2
(45) Date of Patent: Nov. 17, 2026

(54) FOOD CONTAINER OF FIBER PULP

(71) Applicant: Brødrene Hartmann A/S, Gentofte (DK)

(72) Inventor: Henrik Gotlieb Husted Jensen, Gentofte (DK)

(73) Assignee: Brødrene Hartmann A/S, Gentofte (DK)

( * ) Notice: Subject to any disclaimer, the term of this patent is extended or adjusted under 35 U.S.C. 154(b) by 222 days.

(21) Appl. No.: 18/273,587

(22) PCT Filed: Nov. 3, 2021

(86) PCT No.: PCT/EP2021/080558
§ 371 (c)(1),
(2) Date: Jul. 21, 2023

(87) PCT Pub. No.: WO2022/171319
PCT Pub. Date: Aug. 18, 2022

(65) Prior Publication Data

US 2024/0150066 A1 May 9, 2024

(30) Foreign Application Priority Data

Feb. 12, 2021 (EP) ..... 21156835

(51) Int. Cl.
*B65D 1/34* (2006.01)
*B65D 1/42* (2006.01)
(Continued)

(52) U.S. Cl.
CPC ..... *B65D 1/34* (2013.01); *B65D 1/42* (2013.01); *B65D 21/0233* (2013.01);
(Continued)

(58) Field of Classification Search
CPC ..... B65D 1/34; B65D 1/42; B65D 21/0233; B65D 25/14; B65D 65/466;
(Continued)

(56) References Cited

U.S. PATENT DOCUMENTS 4,801,017 A * 1/1989 Artusi ..... B65D 25/36 206/524.1
7,267,243 B2 * 9/2007 Steg ..... B65D 43/0214 220/359.4
(Continued)

FOREIGN PATENT DOCUMENTS

EP 0890517 A2 1/1999
WO 2009136783 A1 11/2009

OTHER PUBLICATIONS

International Search Report for International Patent Application No. PCT/EP2021/080558 dated Feb. 25, 2022 (4 pages).
(Continued)

*Primary Examiner* — Christopher R Demeree
(74) *Attorney, Agent, or Firm* — Merchant & Gould P.C.

(57) ABSTRACT

The present invention relates to a container of fiber pulp for packaging of food, such as vacuum packaging or modified atmosphere packaging. The container comprises a bottom part and side walls surrounding said bottom part and has at an upper end thereof a circumferential longitudinal rim part having a planer main surface being substantially parallel to the bottom plane and defining an opening of the container. The side walls further comprise a reinforcing element below the longitudinal rim part for generating an increased moment of inertia of the rim part along the longitudinal direction thereof.

18 Claims, 6 Drawing Sheets

(51) Int. Cl.
*B65D 21/02* (2006.01)
*B65D 25/14* (2006.01)
*B65D 65/46* (2006.01)

(52) U.S. Cl.
CPC ..... *B65D 25/14* (2013.01); *B65D 65/466* (2013.01); *B65D 2565/383* (2013.01)

(58) Field of Classification Search
CPC ..... B65D 2565/383; B65D 2565/00; B65D 2565/38; B65D 2565/381; B65D 2565/382; B65D 77/2024; B65D 2565/387; B65D 2577/2025; B65D 2251/0031; B32B 2439/70; B32B 2307/31; B31B 2120/402; B65B 47/10
USPC ..... 229/406, 407; D7/554.3; 206/557, 497, 206/564; 220/359.4, 305, 359.3, 608, 220/643, 657, 659, 675; 426/106, 118, 426/129, 396, 404; 53/432, 423, 453; D9/432
See application file for complete search history.

(56) References Cited

U.S. PATENT DOCUMENTS

| | | | | |
|---|---|---|---|---|
| 8,746,499 | B2 * | 6/2014 | Steg | B65D 77/208 220/780 |
| 2011/0266168 | A1 * | 11/2011 | Longo | B65D 81/262 53/423 |
| 2016/0221742 | A1 * | 8/2016 | Edwards | B65C 3/08 |
| 2020/0024806 | A1 | 1/2020 | Chung et al. | |
| 2020/0277738 | A1 | 9/2020 | Chung et al. | |
| 2021/0347518 | A1 * | 11/2021 | Khan | B65D 25/24 |

OTHER PUBLICATIONS

Written Opinion of the International Searching Authority for International Patent Application No. PCT/EP2021/080558 dated Feb. 25, 2022 (7 pages).
Written Opinion of the International Preliminary Examining Authority for PCT/EP2021/080558 dated Jan. 16, 2023 (5 pages).
International Preliminary Report on Patentability for PCT/EP2021/080558 dated May 16, 2023 (10 pages).

* cited by examiner

28

36

24
18
16
32
10
38
28
36

FOOD CONTAINER OF FIBER PULP

CROSS-REFERENCE TO RELATED APPLICATIONS

This application is a National Stage Application of PCT/EP2021/080558, filed 3 Nov. 2021, which claims the benefit of application Ser. No. 21/156,835.7, filed 12 Feb. 2021 in Europe, and which applications are hereby incorporated by reference in their entireties. To the extent appropriate, a claim of priority is made to each of the above disclosed applications.

TECHNICAL FIELD

The present invention relates to a container, preferably a container of pulp for the packaging of foods.

The present invention is particularly suitable to be used in combination with vacuum packaging or modified atmosphere packaging of foods, such as fresh meat or other foods which need to be packed in an enclosed environment, where food is packed in a container and a top film is connected to a top of the container for hermetic sealing the content within the container.

BACKGROUND OF THE INVENTION

Within the technical field of food packaging, such as vacuum packaging or Modified Atmosphere Packaging (MAP) of fresh meat, it is commonly known to use meat trays manufactured from a plastic material. Plastic meat trays for the above-defined packaging processes of fresh meat are easy to produce, cheap in manufacturing costs, and provide stabile mechanical properties of the meat trays, which is essential during packaging of the meat and in the following sealing process, in which a thin film is applied to the top of the tray to hermetically seal the content within the tray.

However, plastic is not a particularly sustainable material, and there is a need for providing food containers from a more environment-friendly material.

Containers made of fiber pulp, e.g. pulp from wooden fibres or non-wood bio fibres, have also been commonly known for packaging food, such as eggs, fruits, etc.

A production process of making containers of moulded pulp is commonly known within the technical field, where a fiber material such as recycled paper and/or cardboard and/or other waste papers are processed into a certain concentration of slurry by a pulp mixer. Other materials could be straw, grass, seaweed etc. The slurry is used in a moulding machine for forming the containers, which afterwards are dried in a dryer, and pressed into compact shape by e.g. a hot press (after press). The above-defined method is just one example of a known manufacturing process.

In order to be able to use these permeable and moist-sensitive pulp containers for packing "wet" foods, and especially for the packing of fresh meat, it is preferred to use a barrier film, e.g. a plastic barrier film, which is arranged on at least one side of the container to render the container moist resistant and gas tight/diffusion tight, so that it can be used to contain the wet products, such as fresh meat, and further to allow a hermetic sealing of the content for the purpose of preservation.

After the meat (or other wet food) is placed in the container, a top film or sheet is sealed over the opening of the container and bonded to the surrounding rim, hereby hermetically sealing the container.

One example of such container is disclosed in EP1160175A1.

The barrier film, which is arranged on at least one side of the container, can be a film of thermoformable material, which is able to be stretched and formed into conformity with the contoured moulded pulp container, preferably at an inner surface of the container.

However, manufacturing food containers of the above-mentioned art comprising pulp creates a number of challenges compared to the manufacture of conventional containers made from plastic.

Containers made from plastic are extremely mechanically stable, and such containers have the ability to return from a deformed state (temporary shape) to the original (permanent) shape induced by an external influence, such as a temperature change or an accidental mechanical impact from e.g. processing equipment during forming or packing.

However, containers from fiber pulp do not have the same mechanical stability as plastic container, and an even relatively small accidental impact on the pulp container during the packing or manufacturing process renders the package instable, and the pulp container will not return to the original shape. Once a product made from fiber pulp has been deformed, it cannot return entirely to its original shape.

During the process of arranging a barrier film, e.g. a plastic barrier film, the pulp container will be subject to forces from the barrier film, which may be arranged on the container via a thermoforming process, in which the barrier film is heated, stretched and pulled down over the inner surfaces of the container. The stretchable barrier film will to some degree pull the side walls of the container inwards, hereby deforming and rendering the container somehow hourglass-shaped.

These above-defined disadvantages create the problem that the upper rim of the container, which upper rim is arranged to establish a connection to the top film/sheet, is not planar, which results in a defect connection between the rim and the top film/sheet, such that the food products are not hermetically sealed, and the entire container and the food contained therein thus have to be discarded.

During the filling of foods, such as meat, into the container, and further during of the process of arranging the top film/sheet onto the rim of the container, the pulp containers are arranged in positioning equipment intended for maintaining the containers in a correctly orientated position in relation to the top film/sheet application equipment.

However, experience have shown that even slight geometric deviations of the container and the container rim lead to the top film/sheet being incorrectly positioned and connected.

Further, during the above-defined processes, the pulp containers are conveyed through the production line via belt conveyers, which are commonly known within the art. However, as the containers may have been subject to unintentional external forces, which renders the containers with a non-original geometry, a problem of the bottom surface of the container being non-planar is created, which results in insufficient contact with the conveyers, further resulting in an undesired movement and rotation of the containers on the belt conveyers.

Such undesired movement of the containers may result in a blocking of the belt conveyers and/or in the containers not being aligned with the following processing equipment, or even further result in accidental impacts on the containers.

It is an object of the present invention to provide a container of fiber pulp which solves the above-defined problems.

The above object and advantages, together with numerous other objects and advantages, which will be evident from the following description of the present invention, are according to the present invention obtained by:

A container of fiber pulp for the packaging of food, such as vacuum packaging or modified atmosphere packaging, the container comprising a bottom part defining a bottom plane, and upwardly extending side walls surrounding the bottom part and having inner wall surfaces facing the interior of the container and outer wall surfaces facing the outside of the container, the upwardly extending side walls comprising, at an upper end thereof, a circumferential longitudinal rim part having a planar main surface being substantially parallel to the bottom plane, the container is arranged with a junction between the side walls and the rim part, where a substantial part of the junction, being non-parallel in relation to a longitudinal direction of the rim part, for generating an increased moment of inertia of the rim part along the longitudinal direction thereof.

The container of pulp may be manufactured according to the commonly known processes as discussed above.

In order to be able to hermetically seal the content, such as fresh meat, within the container, it is necessary to apply onto the top of the container a top film/sheet which is connected to the rim of the container.

As discussed earlier, containers made from pulp, such as moulded pulp, do not have the same mechanical properties as e.g. containers made from plastic material. If the container from fiber pulp is subjected to unintentional external forces during manufacturing or packing of the food products, the pulp container does not return to its original shape. If the rim of the container has been bent downwards due to an accidental impact on the rim, the upper surface of the rim is no longer planar and no longer parallel with the bottom part. Hereby, the rim is no longer suitable to be connected to the top barrier film, which seals the container.

The container is arranged with a junction between the side walls and the rim part, where the junction along the rim part follows a line which is non-parallel in relation to a longitudinal direction of the rim part. Hereby an increased moment of inertia of said rim part along the longitudinal direction thereof is generated.

The rim part, when exposed to an unintentional external force, will bend downwards/upwards around the moment of inertia reference line (the axis upon which the rim part will rotate), which reference line is depending on the form of the junction.

If the junction is a straight line being parallel to the longitudinal direction of the rim part, the moment of inertia reference line will be coincident with the junction.

However, if the junction follows a non-parallel line in relation to the longitudinal direction of the rim part, the moment of inertia reference line is defined by a straight line extending through the middle of the non-parallel line. This has the technical and surprising effect that an increased moment of inertia of the rim part is generated along the junction and the longitudinal direction of the rim part.

A part of the junction may follow a parallel line in relation to the trim part, and a part of the junction follows a non-parallel line in relation to the rim part, but in order to establish an optimal result, the non-parallel part defines a substantial part of the junction, such as between one third and the half of the extension of the junction. The non-parallel part preferably defines at least 10% of the junction, such as at least 25% of the junction, and most preferred at least 50% of the junction. The greater the extent of the non-planar junction, the greater the moment of inertia of the rim part.

The non-parallel part may by a straight line, which is arranged non-parallel in relation to the longitudinal direction of the rim part, e.g., a zigzag shape, but may also be a curved line, such as an arc or a series of curves, such as a wave-shaped junction, or even a combination of straight and curved lines.

According to a further embodiment of the invention, a main part of the junction is non-parallel in relation to a longitudinal direction of the rim part.

Tests performed by the applicant have shown that the best result of an increased moment of inertia is achieved if a main part of the junction follows the non-parallel line. Preferably, substantially the entire junction follows a non-parallel line.

According to a further embodiment of the invention, the container is made from fiber pulp.

As described earlier, containers made from fiber pulp do not have the same mechanical stability as plastic container. Therefore, an even relatively small accidental impact on the pulp container during the packing or manufacturing process renders the package instable, and the pulp container will not return to the original shape. Once a product made from fiber pulp has been deformed, it cannot return entirely to its original shape. Therefore, when arranging the above-defined junction in combination with a container made from fiber pulp, it is possible to manufacture a sustainable container with substantially the same strong mechanical properties of the rim part as a container made from a plastic material.

According to a further embodiment of the invention, the junction comprising a non-straight line.

The most optimal result is achieved if the junction follows a non-straight line. The larger the extent of the non-straight line in relation to the junction, the larger the increased moment of inertia.

According to a further embodiment of the invention, the junction is wave-shaped and comprises a number of waves having a wavelength with a direction being substantially parallel to the rim part.

In a preferred embodiment of the invention, the junction is wave-shaped, such that the wave lengths are arranged with a direction that is substantially parallel to the longitudinal direction of the rim part.

An inner part of the rim defines a boundary between the wall and the rim part, and as the junction is wave-shaped, the moment of inertia reference line (the axis upon which the rim part will rotate) is defined by a straight line, which extends parallel to the wavelengths between the wave crests and the wave throughs, which corresponds to the wave amplitude.

According to a further embodiment of the invention the upwardly extending side walls further comprising a reinforcing element below said longitudinal rim part, said junction being arranged between said reinforcing element and said rim part.

The upwardly extending walls of the container may be arranged with a reinforcing element, which is arranged on the outer surface of the side walls for generating an increased moment of inertia of the rim part along the longitudinal direction thereof.

As the reinforcing element is arranged on the outer surface of the side walls, and in connection with the rim art, the reinforcing element generates an increased moment of inertia along the longitudinal direction of the rim part, so that the rim is more capable of withstanding external forces, resulting in the rim maintaining its original planar shape.

According to a further embodiment of the invention, the reinforcing element is a longitudinal reinforcing rib extending substantially parallel to and below the rim part.

Tests have shown that when arranging the reinforcing element as a longitudinal reinforcing rib extending substantially parallel to and below the rim part, preferably immediately below the rim such that the rib is connected to the rim part, generates promising results in increasing the moment of inertia along the longitudinal direction of the rim part.

In an alternative to a longitudinal reinforcing rib, the reinforcing element could comprise a number of distanced individual reinforcing elements arranged below the rim part.

According to a further embodiment of the invention, the longitudinal reinforcing rib is wave-shaped and comprises a number of waves having wavelengths with a direction being substantially parallel to the rim part.

In a preferred embodiment of the invention, the longitudinal reinforcing rib is wave-shaped and is arranged on the substantially vertical side walls, such that the wave lengths are arranged with a direction that is substantially parallel to the longitudinal direction of the rim part.

An inner part of the rim defines a boundary of the reinforcing rib, and as the reinforcing rib is connected to the rim part and the reinforcing rib is wave-shaped, the moment of inertia reference line (the axis upon which the rim part will rotate) is defined by a straight line which extends parallel to the wavelengths between the wave crests and the wave throughs, which corresponds to the wave amplitude.

According to a further embodiment of the invention, the upwardly extending side walls define the wave-shaped rib, the wave-shaped rib having a material thickness substantially equal to the thickness of a remaining part of the upwardly extending side walls.

The wave-shaped rib is preferably incorporated into the side walls, hereby being defined by the side walls. Arranging the wave-shaped rib as part of, and having the same material thickness as the side walls, decreases the amount of necessary material to be used and establishes the container with maximum volume, and at the same time maintains the stackability of the containers. It is noted that during transportation of the empty manufactured containers, the containers are stacked on top of each other.

According to a further embodiment of the invention, the wave-shaped rib comprises a number of crest and through points being raised in respect to the planes of the outer wall surfaces.

Arranging the wave-shaped rib entirely extending from the outer surface of the walls, provides the rim with an even more increased moment of inertia.

In a basic embodiment, the wave throughs could be planar with the outer surface of the side walls, but in a preferred embodiment, also the wave throughs are raised from the outer surface of the side walls, hereby increasing the effect of the wave-shaped rib.

According to a further embodiment of the invention, the upwardly extending side walls below the reinforcing element comprise a number of substantially vertical reinforcing ribs extending from the bottom for generating an increased moment of inertia of the upwardly extending side walls, along a direction parallel to the longitudinal direction of the longitudinal rim part, respectively.

In a preferred embodiment the container comprises a number of substantially vertical reinforcing ribs on the sidewalls, and preferably integrated therewith, for enhancing the stability of the side walls in general. As the vertical reinforcing ribs extend from the bottom, and preferably from below the bottom, and towards the rim part, the moment of inertia of the walls in a direction parallel with the longitudinal rim is increased. This results in the walls having less tendency to bend inwards, e.g. under the process of thermoforming the barrier film onto the inner surfaces of the container.

According to a further embodiment of the invention, the substantially vertical reinforcing ribs are arranged independently in relation to the junction.

The substantially vertical reinforcing ribs are preferably arranged independently in relation to the junction. The moment of inertia of the upper rim part is not equal to the moment of inertia of the substantially vertical side walls, and the two different parts of the container and the mechanical strength of these two parts have to be dimensioned independently of each other. Therefore, with the term "independently" is meant that the substantially vertical reinforcing ribs do not, or only minimal, contribute to the increased moment of inertia of the rim part.

According to a further embodiment of the invention, the container comprises a barrier for making the container diffusion tight.

In order for the container to better accommodate the "wet" foods, the container comprises a barrier which may be arranged on the inner surfaces of the container or on the outer surfaces of the container which makes the container diffusion tight. The container may in alternative embodiment comprise a barrier on both the inner and outer layer in order to shield the fibre material from moisture, from both the inside and the outside of the container.

According to a further embodiment of the invention, the barrier being arranged on the inner wall surfaces, an inner surface of said bottom and on said planar main surface of said rim.

It is preferred that the barrier covers the inner wall surfaces, the inner bottom surface and/or the main surface of the rim. The covering of the inner surfaces of the container makes the walls and bottom parts diffusion tight, and covering the main surface of the rim, establishes a suitable connection surface for the top film/sheet, such that the connection between the two is also diffusion tight.

The barrier may be a film which is arranged on the inner wall surfaces and the inner bottom surface, preferably by a thermoforming process.

The barrier film may be provided as a laminate, which comprises a diffusion-tight middle layer of a copolymer, such as ethylene vinyl alcohol, and outer layers having fibrebonding properties, such as Polyethylene.

The middle layer of copolymer, such as ethylene vinyl alcohol, provides good diffusion-tight properties of the barrier film, but is not suitable as a material for being thermoformed onto the surface of the pulp container. Therefore, each side of the middle layer is provided with an outer layer of a material suitable for thermoforming and which provides good bonding properties to the surface of the container on the one side and the top film/sheet on the other side. The outer layers are preferably made from polyethylene, however, other suitable materials providing the same characteristics may be used.

According to a further embodiment of the invention, the barrier having a thickness of between 20-125 μm, preferably between 20-80 μm, most preferred between 20-60 μm.

When constructing the container, it is crucial to obtain the desired mechanical strength of the container, but also crucial to have as little a product thickness as possible while maintaining the desired mechanical strength. Therefore, it is desirable to provide a barrier film which adds minimal thickness to the product and still provides for the desired effect of the film, i.e. a diffusion-tight container and good bonding properties in relation to the container and the top film/sheet.

Experiments have shown that the optimal minimal thickness of the barrier film, compared to desired container dimensions, is achieved with a thickness of the barrier film of approximately 20-125 μm, preferably between 20-80 μm, most preferred between 20-60 μm.

Tests have shown that when the barrier is arranged onto the container, e.g. as a film which is thermoformed onto the surfaces of the container, excessive stretching of the film before application onto to container, decreases the material thickness of the film, which results in a minimal material thickness of the barrier.

However, the increased stretched film will increase the pulling force of the walls as previously described, hereby rendering the container even more hourglass-shaped, but due the reinforcing elements, the container maintains its shape and the main surface of the rim part maintains its orientation being substantially parallel to the bottom plane. With the present invention, it is thus possible to provide a container of fiber pulp with a minimal barrier thickness and maintained mechanical properties.

According to a further embodiment of the invention, the barrier film is peelable from the bottom and wall surfaces.

In order to maximize the sustainability of the container, it is preferred that the barrier film can be pealed off the container once it has been used for subsequent recycling.

According to a further embodiment of the invention, the container comprises a lower main surface of the bottom part, which when the container is placed on a planar surface, is raised in relation to the remaining lower surface of said bottom part.

During the process of packing the containers with food, the containers are conveyed on belt conveyers through the production line between individual stations (filling and sealing), where the containers made from pulp have a tendency to rotate and not being aligned with the processing equipment. The rotation is a result of the containers being made from pulp. Pulp containers do not have the same mechanical strength and precise dimensions as plastic containers, and as the pulp containers may have been subject to unintentional external forces, the bottom of the containers may not be entirely planar. If the containers do not have sufficient contact with the conveyers, they will rotate and the production line will stop.

To solve the above problem, the bottom comprises parts which project from the bottom surface, such that when the container is placed on a planar surface, a main portion of the container is raised in relation to the projecting parts. Hereby, the projecting parts ensure constant contact with the conveyors such that variations of the geometry of the container do not cause it to rotate.

According to a further embodiment of the invention, the lower surface of said container, on the corners thereof, comprises projecting elements for arranging said lower main surface being raised in relation to the planar surface.

Arranging the bottom corners as projecting elements has proven to be the most stabile configuration. Alternatively, a circumferential projecting rim arranged on the periphery of bottom surface could be proposed; however, due to the above defined ribs, which extend from below the bottom, whereby the bottom also comprises a pattern of supporting ribs, a circumferential rib is not possible. The defined invention thus provides the possibility of having both a pattern of supporting ribs on the bottom and a container which maintains its orientation on the production line.

According to a further embodiment of the invention, a lower surface of the bottom part comprises a part having a rough surface structure compared to the remaining part of the lower surface.

In order to increase the bottom friction of the container to avoid unintentional rotation, it is preferred to arrange part or parts of the bottom surface with an increased roughness compared to the remaining part.

After the container has been formed, e.g. due to a molding process, it is subjected to an after-press process, where a press is arranged to exert less pressing force on certain parts of the container, resulting in these parts having a rough surface structure compared to the remaining surface parts.

This has the technical effect that the friction of the bottom surface is increased, and the overall surface structure is maintained. It is not desirable to arrange the entire bottom surface with a "rough" surface structure, as such rough structure has a tendency to springle fibers into the container below when the containers are stacked empty, which is undesirable.

According to a further embodiment of the invention, the container comprises a denester.

In order that the containers can be stacked when being empty, and afterwards be separated easily, the container comprises a number of denester elements. The denester elements arrange the containers, when being stacked, with an intermediate distance between the stacked containers.

The denesters are preferably arranged below and in contact with the reinforcing element at the side wall corners, which, besides the denester effect, also provides an additional stability to the corner part of the rim.

The denesters may in an alternative embodiment be arranged on the bottom surface of the corners. In addition to the denester function, this embodiment establishes a distance between the lower main surface and a support surface upon which the container is placed. This has the technical effect that the stability of the container on the production line is maintained, and the containers are prevented from rotating.

It is preferred that the raised lower main surface is kept at a minimum, whereby the height of the container is not unnecessarily increased, which is undesirable. When stabling the filled containers, it is preferred to keep the stabled height at a minimum. It is however also desirable to have a minimum height of the container in relation to the process of thermoforming the container with the barrier layer. During the thermoforming, where a barrier film is heated and stretched over the inner surface of the container, it is easier to apply the film onto a container having a lower height, which requires less stretch of the film, which results in less deformation of the side walls and a less hourglass-shape of the container.

Keeping the raised main surface at a maximum, such as 2 mm, and preferably below 1 mm, arranges the container with a minimum height. A main surface being raised more than 2 mm could be implemented in order to maintain the orientation of the containers on the production line.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art.

Figure 1:
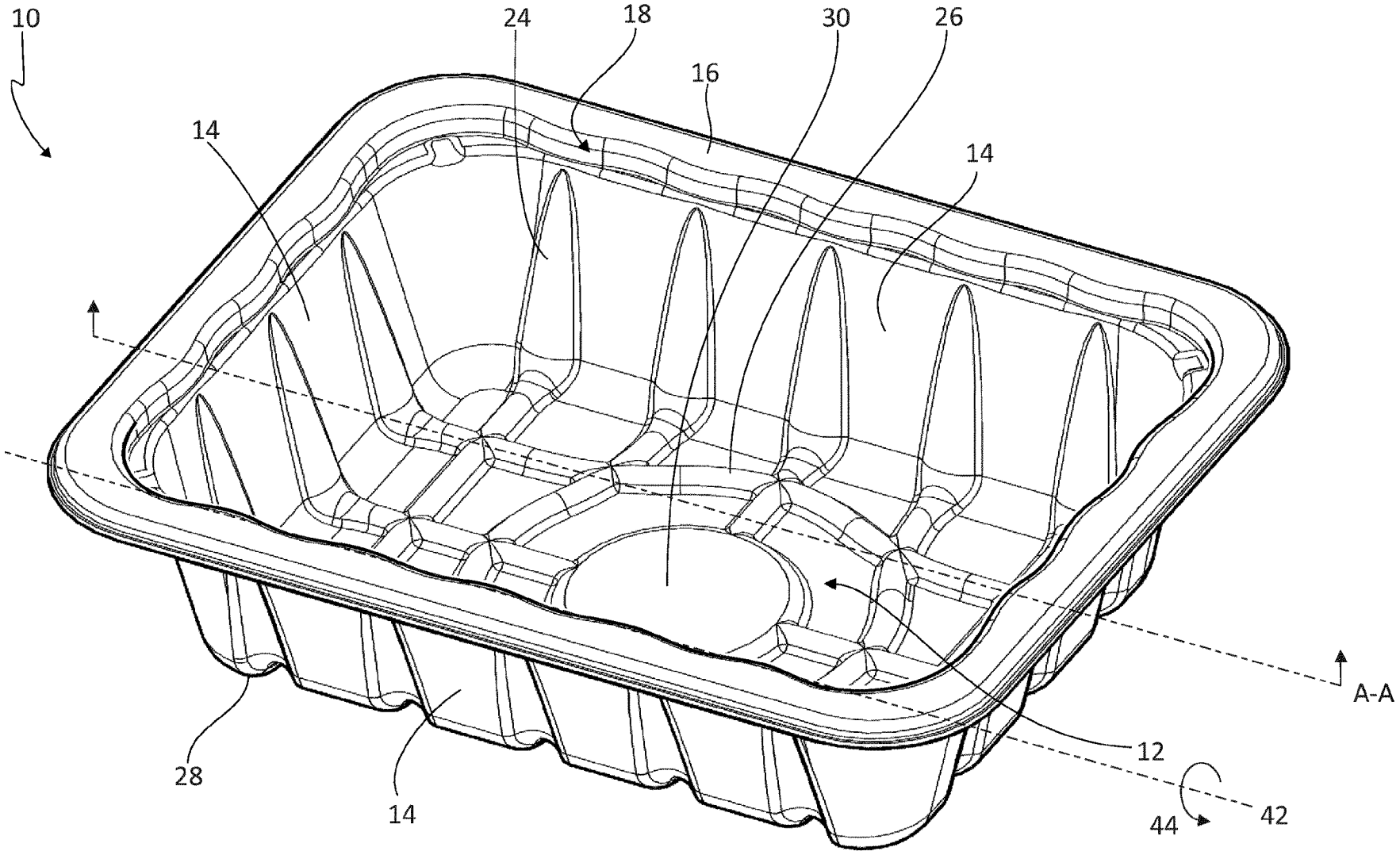
FIG. 1 is an upper perspective view of the container.

FIG. 1 is an upper perspective view of a container 10 for the packaging of food, such as vacuum packaging or modified atmosphere packaging. The container 10 comprises a bottom 12 and upwardly extending side walls 14, which surround the bottom 12 and provides an opening into the container. The side walls 14 comprise, at an upper end thereof, a circumferential planar rim 16, which surrounds the opening and creates a surface onto which a top film/sheet (not shown) can be attached. As described earlier, it is of the most importance that the rim 16 is kept planar such that a correct and tight seal between the container 10 and the top film/sheet can be achieved.

The side walls 14 comprise a reinforcing element 18 below the rim 16, said reinforcing element 18 being arranged as a longitudinal reinforcing rib having a wave-shaped configuration such that the junction between the walls and the rim are wave-shaped and hereby arranged non-parallel with the walls.

The reinforcing element 18 is arranged as part of the side walls 14, and the rim 16 extends from the reinforcing element 18, whereby the inner part of the rim 16 defines a boundary of the wave-shaped pattern of the reinforcing element 18. Hereby, the moment of inertia reference line 42, which is the line around which the moment of inertia is directed, and the line around which the rim 16 will rotate 44 due to an external force.

As can be seen from the figure, the reference line 42 is, due to the wave-shaped configuration of the reinforcing element 18, located through the wave amplitude, i.e. between the wave crests 20 (FIG. 2) and the wave throughs 22 (FIG. 2), whereby the moment of inertia is established through a non-straight construction part, which renders the rim 16 more stable.

The side walls 14 and the bottom 12 comprise a pattern of supporting ribs 24, 26, which provides stability to the sidewalls 14 and bottom 12 in general. As can be seen from the figure, the vertical reinforcing ribs 24 of the side walls 14 extend from below the bottom 12 and in continuation with the bottom ribs 26, which feature provides stability of the container 10 at the junction between the bottom 12 and the side walls 14.

The bottom 12 of the container 10 is arranged with a planar center part, also referred to as suction part 30, which provides the possibility of lifting the container by suction via a suction cup during the production line.

Figure 2:
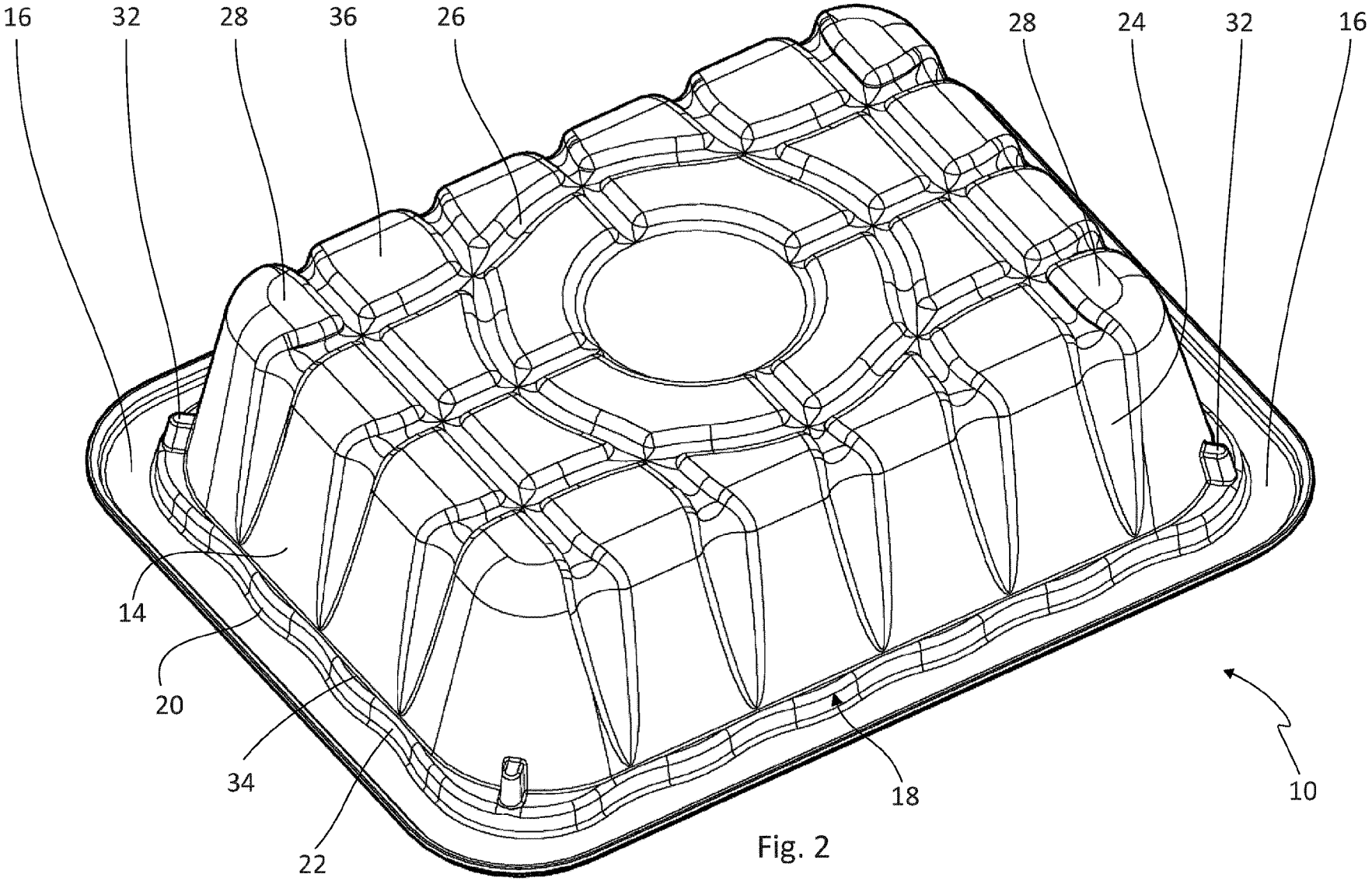
FIG. 2 is a lower perspective view of the container.

FIG. 2 is a lower perspective view of the container 10. The wave-shaped reinforcing element 18 is more clearly shown in FIG. 2, where it is evident that the reinforcing element 18 is arranged towards the outside of the container 10, such that the wave crests 20 raise from the outer surface of the side walls 14, with a distance 34.

In a basic embodiment, the wave throughs 22 are planar with the outer surface of the side walls 14, but in a preferred embodiment, also the wave throughs raise from the outer surface of the side walls 14, which increases the effect of the reinforcing element 18.

The vertical reinforcing ribs 24 are shown arranged independently in relation to the reinforcing element 18.

The bottom 12 of the container 10 is provided with a pattern of bottom supporting ribs 26, hereby dividing the bottom surface into a number of bottom elements, which in the illustrated embodiment include four corner elements 28 and a number of main surface elements 36. The main surface elements 36 include all the bottom elements except the corner elements 28.

In order for the containers to be stacked when being empty, and subsequently easily separated, the container comprises a number of denesters 32. The denesters 32 arranges the containers 10, when being stacked, with a distance between the stacked containers.

In the shown embodiment, the denesters are arranged below and in contact with the reinforcing element 18 at the side wall 14 corners, which besides the denester effect, also provides an additional stability to the corner part of the rim 16.

The denesters 32 may in an alternative embodiment be provided on the bottom surface of the corner posts 28. Besides the denester function, this embodiment establishes a distance between the main surface elements 36 and a support surface, upon which the container 10 is placed. This has the technical effect, as previously disclosed, that the stability of the container 10 on a production line is maintained and the containers are prevented from rotating.

Figure 3:
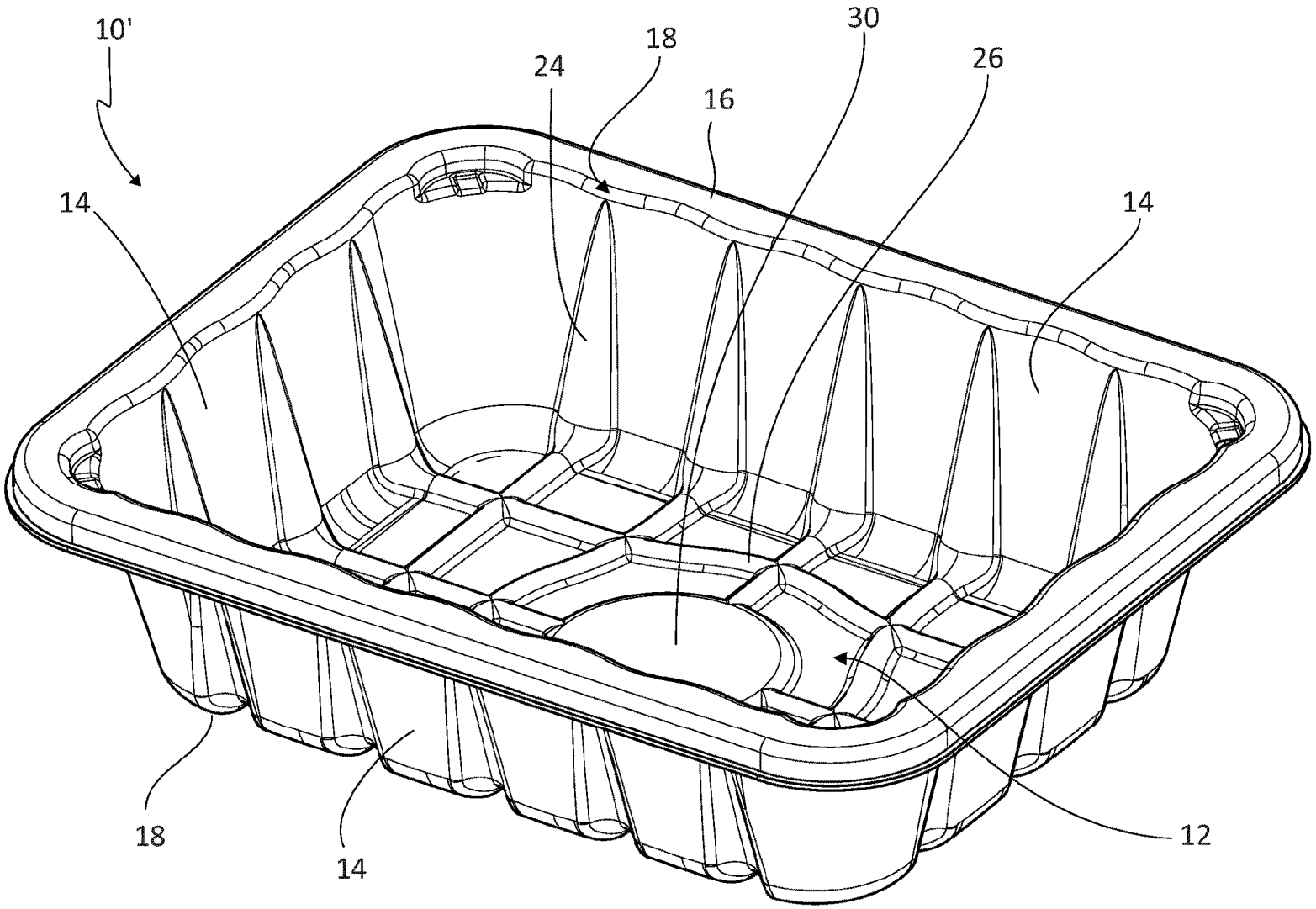
FIG. 3 is an upper perspective view of the container without a rib.
Figure 4:
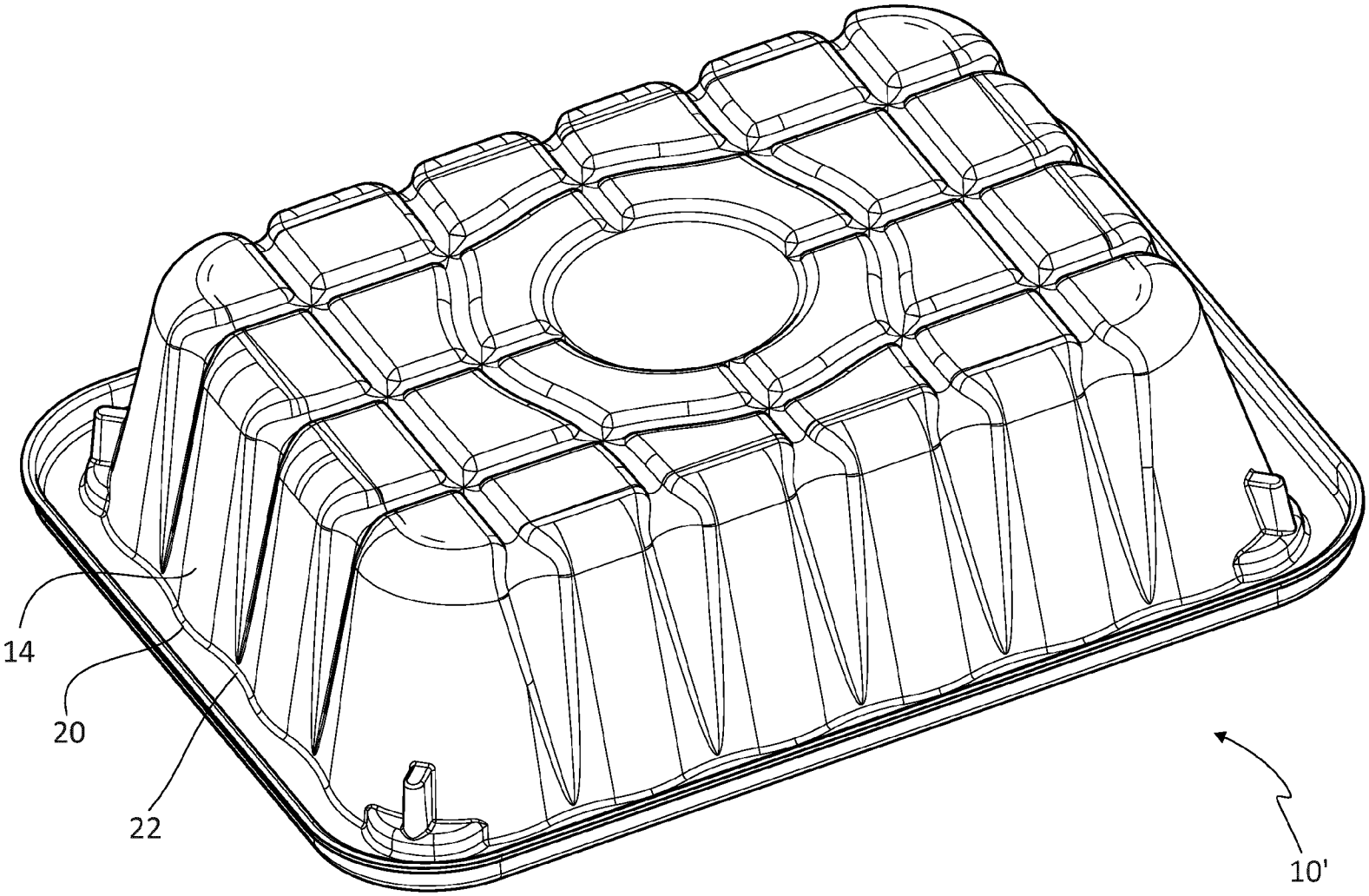
FIG. 4 is a lower perspective view of the container without a rib.

FIG. 3 and FIG. 4 are upper and lower perspective views, respectively, of a container 10' without the reinforcing element 18. Instead of the wave-shaped reinforcing element 18, the walls 14 are at the junction between the walls 14 and the rim 16 arranged with a wave-shaped configuration, such that the junction is arranged non-parallel in relation to the longitudinal direction of said rim part 16.

Figures 5A, 5B, 5C, 5D:
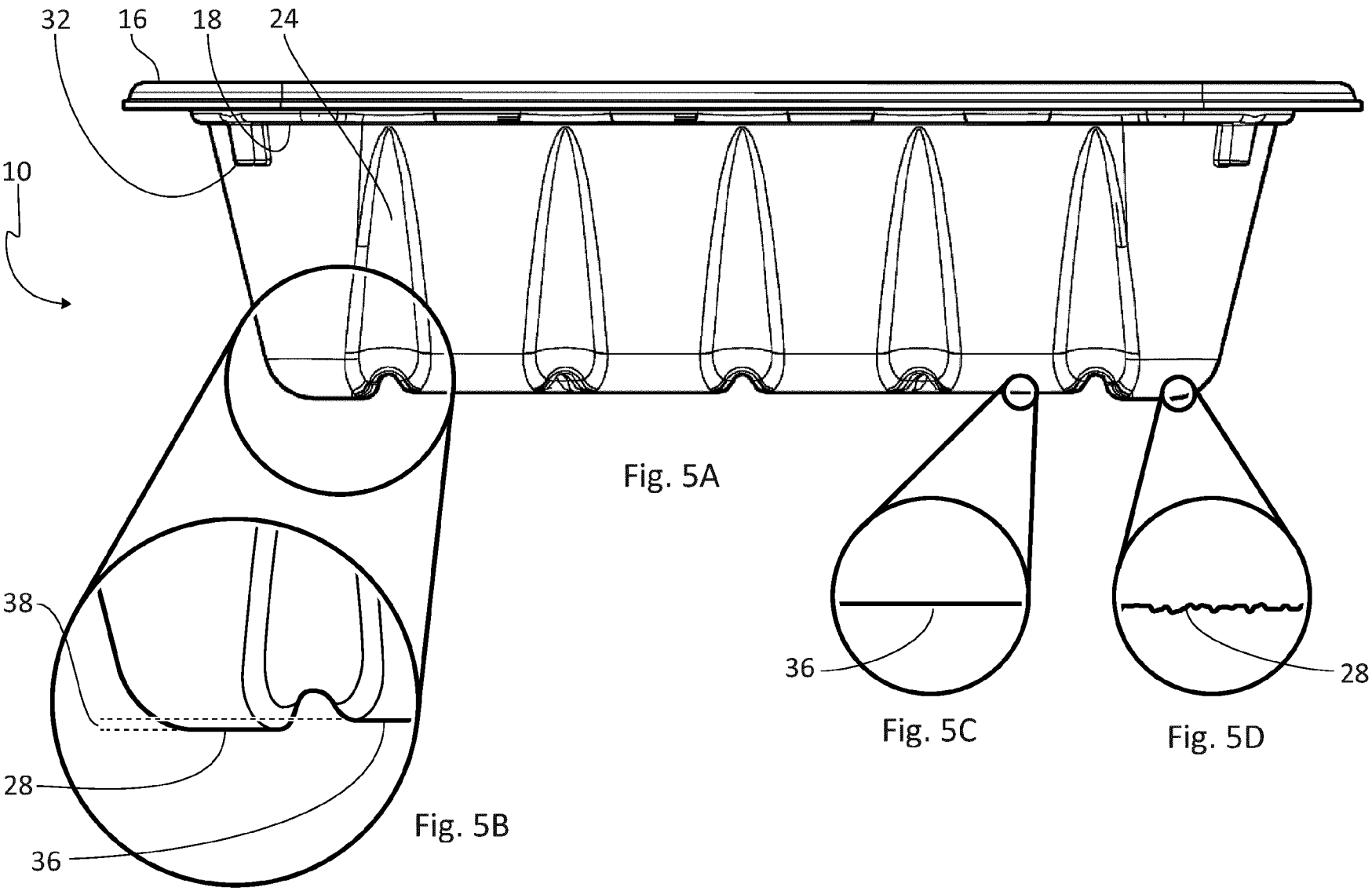
FIG. 5A is a side view of the container.
FIG. 5B is a blow-up of a corner part of the container.
FIG. 5C is a blow-up of a surface of the bottom of the container.
FIG. 5D is a blow-up of a surface of a corner part of the container.

FIG. 5A is a side view of the container 10, showing the same technical features as described in relation to FIGS. 1 and 2.

FIG. 5B is a blow-up of a corner part of the container 10. The figure illustrates a corner post 28 and a main surface element 36 next to the corner post 28. The corner post 28 projects downwards in relation to a plane defined by the main surface element with a predefined distance, also called the bottom height 38. The arranging of the main part of the bottom 12 at a bottom height 38 has det above-defined technical effect that the stability of the container 10 on the production line is maintained and the containers 10 are prevented from rotating.

The bottom height 38 should be sufficient to arrange the main part of the bottom 12 at a distance from a support surface and at the same time not contribute to an unnecessary increase of the overall height of the container, which as previously disclosed, is undesirable. Keeping the raised main surface at a minimum arranges the container with a minimum height and has the further advantage that, when filling the container with the desired content, the weight of such content will force the central part of the bottom (the belly) in contact with the below surface, hereby increasing the contact surface of the container, which generates increased friction therewith.

FIG. 5C-5D are blow-ups of a surface of the bottom 12 of the container 10. The figures illustrate a corner post 28 and a main surface element 36 next to the corner post 28. As can be seen from the figures, the corner post 28 comprises a surface having greater roughness compared to the surface of the main surface element 36. This feature can be used in combination with the embodiment disclosed in FIG. 3B or in an embodiment where corner posts 28 and main surface elements 36 have substantially the same height.

Arranging the corner posts 28 and/or a number of main surface elements 36 with a surface having increased roughness, increases the bottom friction of the container and avoids unintentional rotation on the production line.

Figures 6A, 6B:
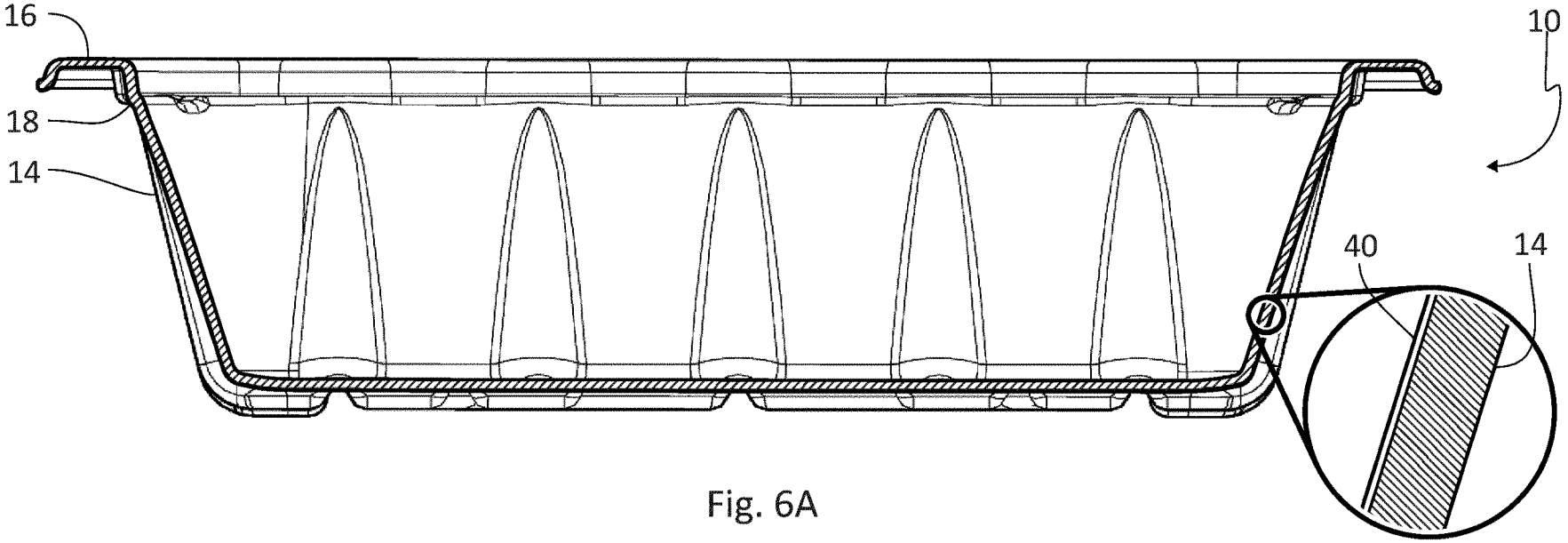
FIG. 6A is a cross-sectional view along line A-A in FIG. 1.
FIG. 6B is a blow-up of a cross-sectional view according to FIG. 6A.

FIG. 6A is a cross-sectional view of the container 10 along the line A-A in FIG. 1. The container 10 comprises the same features as disclosed in relation to FIGS. 1-2 and 4-5D.

FIG. 6B is a blow-up of the cross-sectional view according to FIG. 6A. The figure shows a side wall 14 where a barrier film 40 is arranged on the inner surface of the wall. The container 10, made from permeable and moist-sensitive pulp, is not suitable to be used in combination with "wet" foods such as fresh meat, and for that reason it is preferred to use a barrier film 40 arranged on the inner side walls 14 and the inner surface of the bottom 12, in order to render the container moist-resistant and gas tight/diffusion tight, so that it can be used to contain fresh meat and further to allow a hermetic sealing of the content by use of a top film (not shown) for the purpose of food preservation.

LIST OF REFERENCE NUMBERS

10, 10' Container
12 Bottom
14 Side wall
16 Rim
18 Reinforcing element
Wave crest
22 Wave through
24 Vertical reinforcing rib
26 Bottom rib
28 Corner element
Suction part
32 Denester
34 Crest distance
36 Main surface element
38 Bottom height
Barrier film
42 Moment of inertia reference line
44 Rotation direction

The invention claimed is:

1. A container for packaging of food, such as vacuum packaging or modified atmosphere packaging, said container comprising a bottom part defining a bottom plane, and upwardly extending side walls surrounding said bottom part, and having inner wall surfaces facing the interior of said container and outer wall surfaces facing the outside of said container, said upwardly extending side walls comprising, at an upper end thereof, a circumferential longitudinal rim part having a planer main surface being substantially parallel to said bottom plane, said container being arranged with a junction between said side walls and said rim part, wherein at least 50% of said junction is non-parallel in relation to a longitudinal direction of said rim part, for generating an increased moment of inertia of said rim part along the longitudinal direction thereof, wherein said container comprises a barrier for making the container diffusion tight, and wherein said barrier is peelable from said bottom part and said wall surfaces, and wherein said junction is wave-shaped and comprises a number of waves having a wavelength with a direction being substantially parallel to said rim part.

2. Container according to claim 1, wherein said container is made from fiber pulp.

3. Container according to 1, wherein said junction comprises a non-straight line.

4. Container according to claim 1, wherein said upwardly extending side walls further comprise a reinforcing element below said longitudinal rim part, said junction being arranged between said reinforcing element and said rim part.

5. Container according to claim 4 wherein said reinforcing element is a longitudinal reinforcing rib extending substantially parallel to and below said rim part.

6. Container according to claim 5, wherein said longitudinal reinforcing rib is wave-shaped and comprises a number of waves having a wavelength with a direction being substantially parallel to said rim part.

7. Container according to claim 5, wherein part of said upwardly extending side walls defines said rib, said rib having a material thickness substantially equal to a thickness of a remaining part of said upwardly extending side walls.

8. Container according to claim 6, wherein said wave-shaped rib comprises a number of crest and through points being raised in respect to the planes of said outer wall surfaces.

9. Container according to 1, wherein said upwardly extending side walls comprise a number of substantially vertical reinforcing ribs extending from said bottom for generating an increased moment of inertia of said upwardly extending side walls along a direction parallel to said longitudinal direction of said longitudinal rim part, respectively.

10. Container according to claim 9, wherein said substantially vertical reinforcing ribs are arranged independently in relation to said junction.

11. Container according to claim 1, wherein said barrier is arranged on said inner wall surfaces, an inner surface of said bottom and on said planar main surface of said rim.

12. Container according to claim 1, wherein said barrier has a thickness of between 20-125 μm.

13. Container according to claim 1, said container comprising a lower main surface of said bottom part, which, when said container is placed on a planar surface, is raised in relation to the remaining lower surface of said bottom part.

14. Container according to claim 13, wherein said lower surface of said container, on the corners thereof, comprises projecting elements for arranging said lower main surface being raised in relation to said planar surface.

15. Container according to claim 1, wherein a lower surface of said bottom part comprises a part having a rough surface structure compared to the remaining part of said lower surface.

16. Container according to claim 1, said container comprising a denester.

17. Container according to claim 1, wherein said barrier has a thickness of between 20-80 μm.

18. Container according to claim 1, wherein said barrier has a thickness of between 20-60 μm.

* * * * *